United States Patent [19]

McKenna et al.

[11] 4,277,312

[45] Jul. 7, 1981

[54] ASCENSION PIPE CLEANING APPARATUS

[75] Inventors: James F. McKenna; Douglas O. Anderson, both of Pittsburgh, Pa.

[73] Assignee: United States Steel Corporation, Pittsburgh, Pa.

[21] Appl. No.: 187,301

[22] Filed: Sep. 15, 1980

[51] Int. Cl.[3] ..... C10B 43/08

[52] U.S. Cl. ..... 202/241; 15/93 A

[58] Field of Search ..... 201/2; 202/241; 134/167 R; 15/93 A

[56] References Cited

U.S. PATENT DOCUMENTS

| | | | |
|---|---|---|---|
| 3,400,052 | 9/1968 | Olsen | 202/241 |
| 3,480,514 | 11/1969 | Kinzler et al. | 202/241 |
| 3,886,694 | 6/1975 | Gouye | 15/104.03 |
| 4,013,518 | 3/1977 | Miko | 202/241 |
| 4,233,119 | 11/1980 | Meyers et al. | 202/241 |

FOREIGN PATENT DOCUMENTS

| | | | |
|---|---|---|---|
| 2150494 | 4/1973 | France | 202/241 |
| 277721 | 11/1970 | U.S.S.R. | 202/241 |

*Primary Examiner*—Frank W. Lutter
*Assistant Examiner*—Roger F. Phillips
*Attorney, Agent, or Firm*—John F. Carney

[57] ABSTRACT

Apparatus is described for cleaning the interior of gooseneck elbows of coke oven ascension pipes. A powered cleaning mechanism carried by the coke oven larry car is mounted on a platform that is reciprocably movable between the larry car and the elbow to be cleaned over a track and roller system protected against the disruptive effects of accumulated coal or other debris. A cam and follower arrangement is operative to automatically guide the operating end of the cleaning mechanism within the interior of the elbow thereby eliminating the need for a workman's manually guiding and manipulating the same.

6 Claims, 6 Drawing Figures

38
56
50
70
72
83
74
76
98
40
68
106
128
120
88
126
94
118
102
36
122
85
60
54
30
12
10
124
104
110
112
86
42
53
80
66
62
24
14
16
81
26
20
84
82
18

38
56
30
40
78
64
72
74
68
128
114
118
34
32
120
116
85
86
42
58
60
80
62
22
24
81
26
84
82

ASCENSION PIPE CLEANING APPARATUS

BACKGROUND

Coke ovens are conventionally equipped with one or more ascension pipes to convey the volatile combustion products released during the coking process into collection manifolds for ultimate discharge into gas treatment equipment. The upper ends of ascension pipes are provided at their nexus with the associated collection manifold with a flow-reversing elbow, termed the "gooseneck", which contains an inspection opening closed by a hinged cover. Carbon, coal tar and the like that are entrained in the flowing gases have a tendency to deposit out into heavy and hard accumulations on the interior surface of the gooseneck thereby requiring frequent cleaning in order to prevent undue restriction of the gas flow to the manifold.

To remove these deposits by manual methods is arduous, time-consuming and dangerous. Accordingly, several forms of mechanical cleaning apparatus have been devised to relieve the workman of this task. Such apparatus are characteristically mounted on the coke over larry car employed to charge the ovens in each battery with coal. It employs a power-operated cleaning mechanism which must be manually or otherwise manipulated to guide the operating end of the mechanism through the inspection opening in the elbow and, thereafter, along the interior of the elbow to remove the deposits by the cutting and/or grinding action of the mechanism.

Operations performed with apparatus that must be manually guided or manipulated remain both arduous and timeconsuming. Others performed by apparatus that are mechanically operated, such as for example, as described in U.S. Pat. Nos. 3,480,514, 3,886,694, 4,013,518 and 4,107,001, while being less arduous to the workman, are still not totally dispositive of the problem due to the fact that these devices employ complex mechanism for manipulating the cleaning tool which is, of course, expensive. Moreover, because the apparatus is caused to operate in a coal- and debris-laden environment, it is subject to frequent breakdown and repair caused by the accumulation of coal and/or other debris on its operating parts or, alternatively, to an assiduous maintenance program, either of which requires the apparatus to be removed from service frequently.

It is to the amelioration of such problems, therefore, that the present invention is directed.

SUMMARY OF THE INVENTION

Accordingly, the present invention provides apparatus for cleaning the interior of coke oven ascension pipe elbows comprising a support base having oppositely spaced, longitudinal beams; a plurality of rollers journaled for rotation at longitudinally spaced locations along each of said beams; a carriage supported by said rollers for translational movement along said base; means for reciprocably moving said carriage along said base; a cleaning tool pivotally secured to said carriage; a cam mounted in fixed relation to said base; and a cam follower connected between said cleaning tool and said cam, whereby the cleaning tool is imparted with a compound movement in response to the action of said cam and said reciprocating means to guidingly manipulate said cleaning tool within said ascension pipe elbow.

Problems attendant with the use of prior art apparatus for cleaning coke oven ascension pipe elbows are avoided by the present invention. The subject apparatus is particularly characterized by simplicity of design rendering its initial cost and its operating costs, especially those connected with maintenance of equipment, at a reduced level.

Because the cam surface employed in the instant apparatus is downwardly facing uder a protective cover and because the track and roller mechanism, which guides the reciprocating movement of the cleaning tool carriage toward and away from the ascension pipe to be cleaned is designed to prevent the disruptive accumulation of debris, the described apparatus is particularly adapted for use in a debris-laden environment such as an attachment to a larry car without danger of operational disruptions caused by the accumulation of coal or other debris on the operating parts of the apparatus.

For a better understanding of the invention, its operating advantages and the specific objectives obtained by its use, reference should be made to the accompanying drawings and description which relate to a preferred embodiment thereof.

DESCRIPTION OF THE PREFERRED EMBODIMENT OF THE INVENTION

Figure 1:
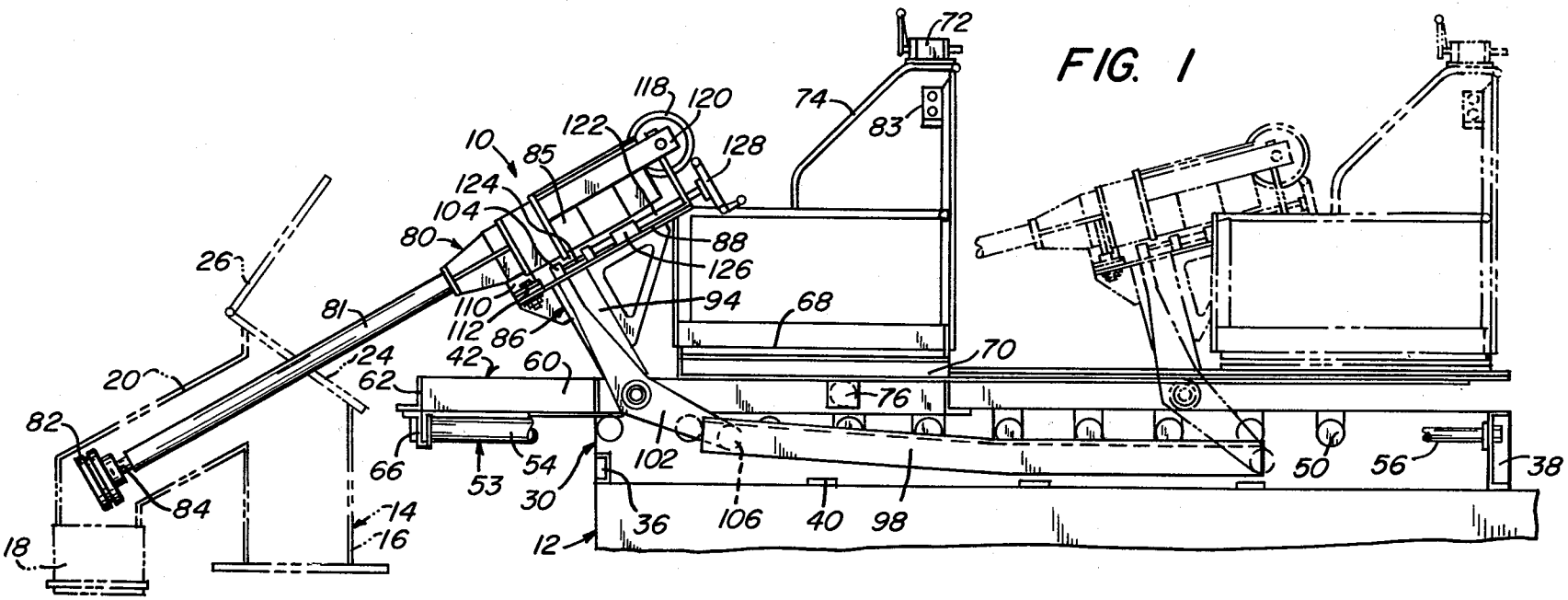
FIG. 1 is an elevated view of a cleaning apparatus constructed according to the present invention in which the facing side support beam is removed for illustration purposes.
Figure 2:
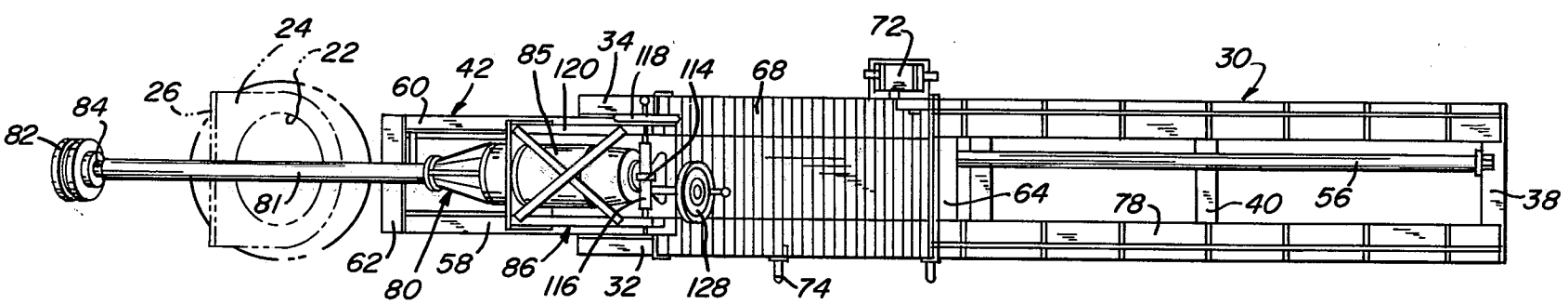
FIG. 2 is a plan view of the apparatus of FIG. 1.
Figure 3:
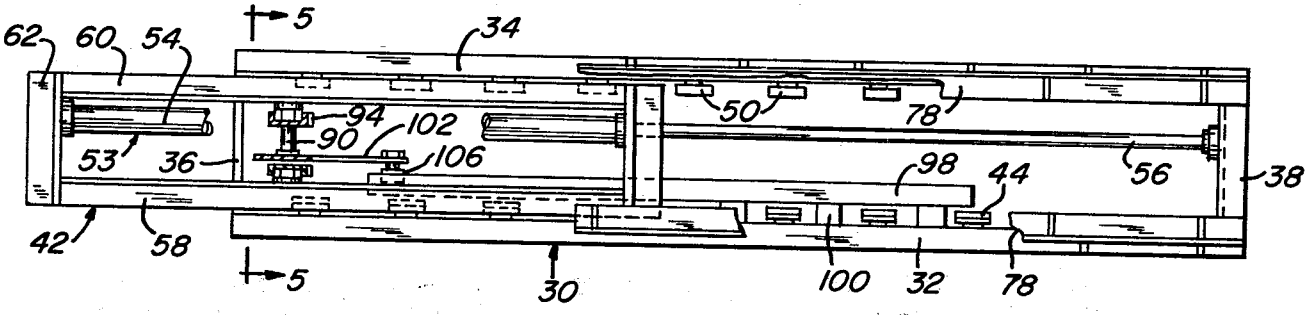
FIG. 3 is a plan view similar to FIG. 2 but with certain parts removed or broken away for illustration purposes.
Figure 6:
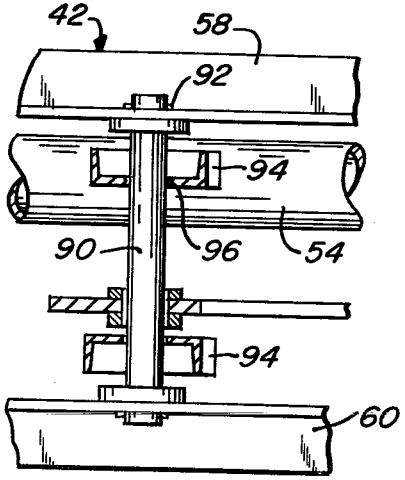
FIG. 6 is an enlarged view illustrating the pivot connection of the cam follower and cleaning tool support according to the present invention.

Referring to FIG. 1, the gooseneck cleaning apparatus 10 of the present invention is schematically shown as being mounted to the frame portion 12 of a conventional larry car that traverses along a coke oven battery as is well known in the art. The apparatus 10 is thus conveniently movable to the ascension pipe, a typical one of which is shown in phantom at 14, surmounting each oven in a battery. The ascension pipe 14 includes a vertical conduit 16 that communicates with an off-take duct (not shown) in the top of the coke oven, a riser duct 18 that communicates with a collecting main (not shown), and the gooseneck elbow 20 that connects the conduit and the riser duct. A clean-out opening 22 is provided in flange 24 at the nexus of the elbow 20 and the conduit 16. This opening 22, which is closed by a hinged closure cover 26, provides access to the interior of the elbow 20 for removing tar and other deposits that may accumulate therein.

The cleaning apparatus 10 includes a support base 30 that is secured to the larry car frame 12 by appropriate attaching means (not shown). The base 30 comprises a pair of longitudinally extending support beams 32 and 34 that are disposed in oppositely spaced relation by laterally extending transverse supports, including front support 36, rear support 38 and a plurality of intermediate supports 40.

A plurality of rollers, journaled for rotation at longitudinally spaced points along the facing surfaces of the respective support beams 32 and 34, are adapted to mount a cleaning tool carriage 42 for translational movement toward and away from the ascension pipe 14. The rollers are preferably arranged in sets. One set, shown on beam 32, comprises rollers 44, the peripheral surface of each of which contains a V-shaped recess or groove 46 for reception of a mating rail 48 that is fixedly secured to the carriage 42 and having a shape generally complimentary to that of the recess. In order to accommodate lateral displacement of the members as for example that due to thermal expansion of the equipment and also in order to reduce the manufacturing tolerances required in the construction of the apparatus 10, the other set, shown on beam 34, and each being indicated by numeral 50, comprises rollers having a generally cylindrical peripheral surface upon which a flat rail 52 on the carriage 42 is caused to bear. By means of this arrangement, movement of the carriage 42, induced by actuation of a hydraulic drive 53 including cylinder 54 connected to carriage 42 and having a piston whose connecting rod 56 is attached to the rear transverse support 38 of the base 30, is effectively guided with respect to the base and, concomitantly, with respect to the ascension pipe 14 to be cleaned.

The cleaning tool carriage 42 comprises rectangularly disposed frame members including oppositely spaced side members 58, 60 and front and rear transverse members 62 and 64, respectively. The carriage 42, as discussed above, is mounted for movement with respect to the base 30 by the bearing engagement of rails 48 and 52 attached to carriage side members, 58 and 60 respectively, with the respective rollers 44 and 50. The cylinder 54 of the hydraulic drive, as shown best in FIG. 1, is connected by means of bracket 66 to the front transverse member 62.

An operator platform 68 is mounted through attaching means 70 upon the carriage 42 at the rear end thereof. Control means 72 for actuating the hydraulic drive 53 are conveniently placed upon guard rails 74 that surround the platform 68 for ready access by the operator positioned thereon.

A set of safety rolls, indicated as 76, are journaled for rotation on the carriage side frame members 58 and 60 adjacent the rear end thereof. These rolls are adapted to engage cooperating fixed rails 78 surmounted on the support beams 32 and 34 of base 30 and operate to prevent the carriage from tipping forwardly when in its extended position with respect to the support base 30.

The cleaning tool, indicated generally as 80, that is operative with the apparatus 10, is of conventional construction. It includes an abrading head 82 on the leading end of an elongated drive shaft 84 rotatable within sleeve 81 that is driven by an electric motor within casing 85. Operation of the tool drive is conveniently controlled by a control switch 83 mounted on the operator platform 68.

The head 82 may contain teeth or flail chains (neither of which is shown) that are effective to remove the accumulated deposits from the interior of the elbow 20 when the head is moved axially of the elbow.

Figure 5:
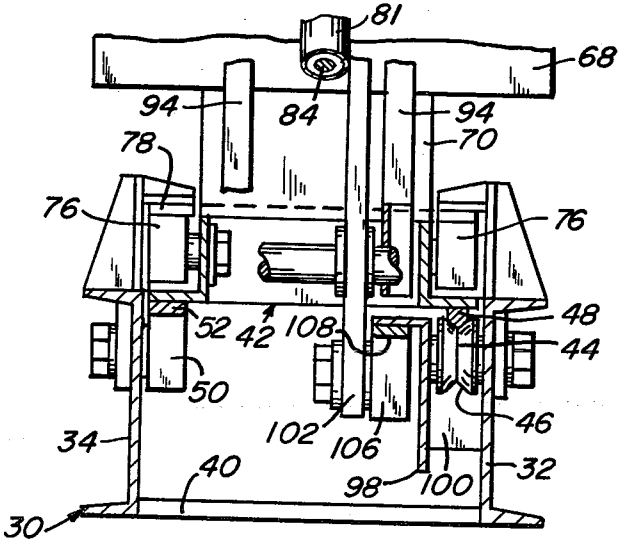
FIG. 5 is an enlarged sectional view, partly broken away, taken along line 5—5 of FIG. 3.
Figure 4:
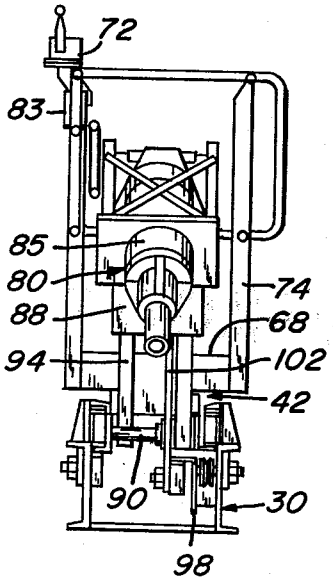
FIG. 4 is a front end view, partly in section, of the apparatus of FIG. 1.

According to the invention the cleaning tool 80 is arranged to automatically move coaxially of the ascension tube elbow 20 upon movement of the carriage 42 with respect to the support base 30. In this way, the cleaning head 82 can be mechanically and automatically moved within the interior of the elbow and accurately along the axis thereof. The workman is thus relieved of the arduous taks of manually manipulating the tool and, since the tool moves accurately along the axis of the elbow the danger of damaging either the tool or the elbow is removed. To accomplish this feature, the cleaning tool 80 is supported on an oscillatable pedestal 86 having a tool support platform 88 at its upper end. The platform 88 is connected to the carriage 42 via a pivot shaft 90 whose opposite ends are fixed to the respective carriage frame side members 58 and 60 by clips 92. A pair of spaced pivot arms 94, attached at one end to the underside of the platform and provided at their other ends with clearance openings 96, connect the platform to the shaft. Thus the pedestal platform 88 is free to oscillate about the shaft 90. The degree of oscillation the platform 88 is permitted to undergo is controlled by a cam 98 fixed to beam 32 of the support base 30, as by means of brackets 100, and a cam follower 102 that is pivotally connected at an intermediate point to the shaft 90. The cam follower 102 is defined by an elongated arm extending oppositely from the shaft 90. At its upper end 104, the follower 102 engages the pedestal platform 88 through a slot (not shown) provided therein to permit the end 104 to pass. A roller 106 is journaled for rotation at the lower end of the cam follower 102 and is adapted to engage the cam 98 which, as shown in FIG. 5, is formed of an angle member having a rail 108 presenting a downwardly facing bearing surface for the roller 106. Continuous engagement of the roller 106 with the bearing surface of cam 98 is maintained due to the fact that the center of gravity of the cleaning tool 80 lies forwardly of the pivot shaft 90 thereby urging the follower in a counter-clockwise direction about the shaft and biasing the roller against the cam's bearing surface.

By means of the described arrangement therefore, once the tool is initially adjusted prior to entering the ascension pipe opening 22, the compound movement imparted to the tool support platform 88 by the linear movement of the carriage 42 with respect to the support base 30 and by the controlled oscillation thereof produced by the cam 98 and follower 102 is translated into a controlled movement of the cleaning tool head 82 substantially coaxailly of the elbow interior. The tool head 82 can be adjusted both laterally and vertically with respect to the ascension pipe opening 22 by means of the adjustable mounting of the tool 80 to the platform 86. Lateral adjustment is provided by virtue of the fact that the tool 80 contains a pivot base 110 engageable with an upstanding pivot post 112 that is fixed to the platform 86. At the rear end of the tool casing 85 is provided a fixed nut 114 within which is operated a worm 116 driven by a handwheel 118 secured to the platform 86 via appropriate framing structure 120.

Vertical adjustment of the head 82 is accomplished by displacement of the pedestal 86 with respect to the cam follower 102, a function produced by a worm shaft 122, the end 124 of which is adapted to engage the upper end 104 of the cam follower 102. The threaded portion of the worm shaft 122 is received in a nut 126 fixed to the tool support platform 86 and driven by a handwheel 128 to vary the position of the platform with respect to the follower. To accommodate such displacement, it will be appreciated that the slot (not shown) permitting penetration of the end 104 of the follower 102 through the platform 86 is slightly elongated longitudinally of the platform.

The operation of the hereindescribed apparatus 10 is as follows. The operating cycle begins with the carriage 42 in the position shown in phantom in FIG. 1 at the rear end of the support base 30 on the larry car frame 12. The larry car is moved to position the apparatus 10 in substantial lateral alignment with the selected ascension pipe 14 whose gooseneck elbow 20 is to be cleaned. The operator, standing on the carriage platform 68, first actuates the carriage drive actuator 72 to operate the hydraulic drive 53 causing cylinder 54 to urge the carriage 42 forwardly of the support base 30 to a position placing the cleaning tool head 82 closely adjacent the cleanout opening 22 whose closure cover 26 has been moved to its open position. Next, the operator aligns the cleaning tool head 82 with the center of the cleanout opening 22 by manipulating the handwheels 118 and 128 to adjust the position of the cleaning tool 80 laterally and/or vertically with respect to the opening. Once the cleaning tool head 82 is properly aligned with the cleanout opening 22, the operator need simply depress actuator 72 for forward movement of the carriage 42 and thereafter, once the head 82 enters the elbow 20 actuate control switch 83 to energize the tool drive motor. As the carriage 42 moves forwardly of the support base 30, the cleaning tool 80 and, concomitantly, its head disposed within the interior of the ascension pipe elbow 20 are caused to undergo compound movement which is produced by the combined effects of the linear translation of the carriage 42 upon support base 30 and the movement of the tool support platform 88 along a curved path effected by the engagement of cam follower 102 with cam 98. This compound movement results in the cleaning head 82 automatically traversing the elbow interior along its axis to remove the deposits from the wall thereof by the cutting or abrading action provided by the rotating head. The operator may manipulate the actuator 72 to move the carriage rearwardly and forwardly several times to permit multiple passes of the head along the elbow interior. Following cleaning of the elbow, the carriage 42 is moved to its rearward position on the support base 30 and the larry car is free to move to another ascension pipe in the coke oven battery where the described cleaning cycle can be repeated.

It will be appreciated that effective operation of cleaning apparatus of the described type, including an operation in which the cleaning tool head is prevented from impacting or otherwise contacting the ascension pipe in a manner that may damage the pipe, is dependent upon the accuracy of relative movement between the parts responsible for guiding the cleaning tool head within the elbow interior. Maintaining such accuracy over extended periods of time has been a problem with prior art devices due to their inability to cope with the accumulation of coal fines and particles or other debris that laden the environment in which the apparatus must operate. The compound movement of the cleaning head 82 of the hereindescribed apparatus within the elbow 20 is governed by the guided relative movement between the carriage 42 and support base 30 and that between the follower 102 and cam 98. Both elements of movement are protected in the described device against disruption caused by the accumulation of particulate material on the parts responsible for such movement. The continued accurately guided movement of the carriage 42 relative to the base 30 is insured because the apparatus employs rails 48 and/or 52 that move with respect to rollers 44 and 50. The rollers rotate but do not translate. Thus, any debris that might otherwise disturb the bearing engagement between the rails and the rollers is discharged from the interface therebetween when the rollers rotate.

Similarly, the accurate interaction between the follower 102, specifically the roller 106 thereon, and the bearing surface on cam 98 is preserved since the bearing surface is downwardly facing and thereby protected against disruption caused by accumulated particulate material.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. Apparatus for cleaning the interior of coke oven ascension pipe elbows comprising:

(a) a support base having oppositely spaced, longitudinal beams;

(b) a plurality of rollers journaled for rotation at longitudinally spaced locations along each of said beams;

(c) a carriage supported by said rollers for translational movement along said base;

(d) means for reciprocably moving said carriage along said base;

(e) a cleaning tool pivotally secured to said carriage;

(f) a cam mounted in fixed relation to said base; and (g) a cam follower connected between said cleaning tool and said cam, whereby the cleaning tool is imparted with a compound movement in response to the action of said cam and said reciprocating means to guidingly manipulate said cleaning tool within said ascension pipe elbow.

2. Apparatus according to claim 1 including:

(a) a pivot pin fixed to said carriage;

(b) cleaning tool supports pivotable about said pin;

(c) said cam follower comprising a simple lever pivotable about said pin, one end of said lever connecting said cleaning tool and the other end thereof being guidingly supported by said cam.

3. Apparatus according to claim 2 in which said cam has a downwardly facing bearing surface, a roller on said other end of said cam follower lever and the center of gravity of said cleaning tool being offset from said pivot pin to place said roller in bearing relation with said cam bearing surface.

4. Apparatus according to claim 2 in which said cleaning tool comprises:

(a) a tool platform movably secured to said carriage by said pivotable cleaning tool supports; and (b) a power-operated tool head adjustably mounted on said platform, said tool head having a rotatably driven operating end insertable into said ascension pipe elbow.

5. Apparatus according to claim 1 in which each of the rollers on at least one of said beams contain a peripheral groove, and a rail fixed to said carriage for guiding reception in the grooves of said rollers.

6. Apparatus according to claim 1 including means for mounting said support base to a coke oven larry car.

* * * * *